US010926318B2

(12) United States Patent
Prietl et al.

(10) Patent No.: US 10,926,318 B2
(45) Date of Patent: Feb. 23, 2021

(54) REFRACTORY CERAMIC GAS PURGING ELEMENT

(71) Applicant: Refractory Intellectual Property GmbH & Co. KG, Vienna (AT)

(72) Inventors: Thomas Prietl, Trofaiach (AT); Bernd Trummer, Graz (AT)

(73) Assignee: Refractory Intellectual Property GmbH & Co. KG, Vienna (AT)

( * ) Notice: Subject to any disclaimer, the term of this patent is extended or adjusted under 35 U.S.C. 154(b) by 158 days.

(21) Appl. No.: 16/134,911

(22) Filed: Sep. 18, 2018

(65) Prior Publication Data

US 2019/0118247 A1 Apr. 25, 2019

(30) Foreign Application Priority Data

Oct. 19, 2017 (CA) ..... CA 2982968

(51) Int. Cl.
*B22D 1/00* (2006.01)
*F27D 3/16* (2006.01)

(52) U.S. Cl.
CPC ..... *B22D 1/005* (2013.01); *F27D 3/16* (2013.01); *F27D 2003/161* (2013.01)

(58) Field of Classification Search
CPC ..... B22D 1/005; F27D 2003/161; F27D 3/16
USPC ..... 266/220, 265, 216, 217, 270, 45, 272, 266/273
See application file for complete search history.

(56) References Cited

U.S. PATENT DOCUMENTS 4,530,864 A * 7/1985 Sugie ..... F27D 27/00 428/34.4
5,249,778 A * 10/1993 Steichert ..... B22D 1/005 266/220
5,421,561 A * 6/1995 Eisermann ..... B22D 1/005 266/100
6,669,896 B1 * 12/2003 Sahlin ..... B22D 1/005 222/603
9,766,014 B2 * 9/2017 Yang ..... C21C 5/48

FOREIGN PATENT DOCUMENTS

JP 2008231554 * 10/2008 ..... B22D 1/005

* cited by examiner

*Primary Examiner* — Scott R Kastler
*Assistant Examiner* — Michael Aboagye
(74) *Attorney, Agent, or Firm* — Medley, Behrens & Lewis, LLC

(57) ABSTRACT

The invention relates to a refractory ceramic gas purging element featuring an insert which was cast into a blind hole within a refractory gas permeable body, which insert is made of a refractory ceramic material and has a density different to that of the body.

13 Claims, 2 Drawing Sheets

REFRACTORY CERAMIC GAS PURGING ELEMENT

RELATED APPLICATION

This application claims priority to Canadian Application for Patent Serial No. CA 2982968, filed on Oct. 19, 2017, and titled "Refractory Ceramic Gas Purging Element", the entirety of which is incorporated herein by reference.

FIELD OF THE INVENTION

The invention relates to a refractory ceramic gas purging element, which is used in secondary metallurgy to blow a gas into a metal melt which is treated in a corresponding metallurgical vessel like a ladle (German: Pfanne).

BACKGROUND OF THE INVENTION

Such gas treatment accelerates the homogenization of a metal melt, carries non-metallic inclusions within the melt up into a corresponding slag and creates other favourable effects.

A generic gas purging element is installed in the bottom and/or wall sections of the metallurgical vessel and insofar part of its inner refractory lining.

A generic gas purging element features an axial extension between a first end, which provides means to supply the gas into the gas purging element, and a second end, at which the gas may leave the gas purging element and enter into the adjacent metal melt.

It comprises a body which is designed to allow the gas, which is supplied at the first end of the gas purging element, to pass through it and to leave the body at the second end of the gas purging element.

This (gas permeable) body typically extends from the second end of the gas purging element towards the first end of the gas purging element, thereby defining an axial height HB of the body, with a first end adjacent to the first end of the gas purging element and a second end, which corresponds to the second end of the gas purging element.

The gas, provided by an external gas source, may be distributed in a gas distribution chamber before passing the gas permeable body.

The gas purging element undergoes severe wear, which requires wear indicators to avoid loss of the structural integrity of the gas purging element with a risk of a metal break-through.

Numerous embodiments of wear indicators have become known in the past.

U.S. Pat. No. 4,530,864 discloses a porous ceramic structure comprising a main body having a recession on the side positioned adjacent to the external surface of the respective container and a sub-body, made of a porous ceramic material and fitted in said recession of said main body. The pre-fabricated sub-body is mortared in said recession (blind hole). If the gas purging element has been worn down to the upper end of this sub-body, the operator should be able to identify this wear visually as the now uncovered upper surface of the sub-body features a different colour compared with a gas permeable body material. This is the theory. In practice it has been found that this embodiment has numerous disadvantages, including:

- The plug must be pre-fabricated and cut into shape to fit into the corresponding blind hole at the first end (cold end) of the gas purging element. This requires additional time and costs.

- In order to secure the sub-body into the blind hole it must be mortared into said hole. Especially the "bottom" of said blind hole (which is the end of the blind hole adjacent to the second end of the gas purging element and the body) is difficult to provide as a flat planar surface but typically features irregularities like depressions, ridges etc. after a corresponding drilling step.
- This requires additional mortar to fill corresponding gaps or to leave said space open. In both cases, no reliable wear indication can be achieved. When the gas purging element has been worn down to the blind hole, the operator cannot distinct any more sections of a porous body material and the mortar/gap/sub-body in a reliable way.
- There is a risk that the mortar shrinks and that the sub-body gets loosened.

OBJECT OF THE INVENTION

It is an object of the invention to avoid these drawbacks and to provide a gas purging element which is easy to produce and provides a reliable wear indicator.

SUMMARY OF THE INVENTION

The invention is based on the following findings:

A gas purging element comprising a ceramic refractory body with a wear indicator arranged in a corresponding blind hole at a first end of the gas purging element is easy to produce and should be maintained as far as possible.

Insofar the invention keeps this generic design but replaces the pre-fabricated sub-body (plug) by a cast monolithic insert. The body can be a pressed or a cast item.

The method to produce such a gas purging element is as simple as reliable. A blind hole is provided at the first end of the refractory ceramic body. Any tolerances, gaps, ridges, depressions etc. are not crucial any more as the blind hole is completely filled with a monolithic material like a castable mix, with no hollow spaces remaining.

Hereinafter, any comparative data (values) referring to the invention, are referenced to the respective lower value, if not otherwise disclosed.

To allow the required distinction between the insert and the surrounding gas permeable body, the ceramic castable used to fill the blind hole is selected to provide an insert with a different density (g/cm$^3$) than that of the surrounding body. This different density can be achieved by use of any of the following:

- different refractory materials (compounds, mixed) for the body and insert respectively (e.g. alumina and MgO based compounds), and/or
- different technologies to manufacture the body and insert (e.g. casting, pressing), and/or
- providing a body and an insert of different gas permeability and/or different open porosity.

Such castables typically comprise water, for example in an amount of 3 to 12% by weight, based on 100% by weight of solids, which water may cause hydration to an oxidic refractory material of the gas permeable body, in particular in case of an MgO-based material.

It has surprisingly been found that such hydration can be substantially reduced or even avoided if the ceramic body with said insert is tempered, for example at temperatures of up to 250° C. Water deriving from the monolithic filler material, for example a low cement castable, can escape during said tempering via the open porosity of the gas permeable body. Preferably such tempering is done immediately after filling the blind hole with the refractory mix.

This technology further reduces or avoids the risk of any loosening of the insert as it was observed in prior art.

In its most general embodiment the invention relates to a refractory gas purging element, featuring:

axial extension between a first end, which provides means to supply a gas into the gas purging element, and a second end, at which the gas may leave the gas purging element and enter into an adjacent metal melt, a body, made of an MgO-based refractory ceramic material and designed to allow the gas supplied at the first end of the gas purging element, to pass through the body and to leave the body at the second end of the gas purging element, wherein the body extends from the second end of the gas purging element towards the first end of the gas purging element, thereby defining an axial height HB of the body, with a first end adjacent to the first end of the gas purging element as well as second end, corresponding to the second end of the gas purging element, a blind hole, which extends from the first end of the body towards its second end, thereby defining an axial height HH of the blind hole, with HB being larger than HH, wherein the blind hole is filled with an insert, made of a refractory ceramic material, which features a density different to that of the body and which is in-situ cast into said blind hole.

The insert should be tempered after casting.

The axial height HH of the blind hole typically corresponds to at most 50% of the axial height HB of the body, with optional upper limits of 40%, 30% or 25%.

The shape (inner contour) of the blind hole corresponds to the outer contour (shape) of the insert following the basic idea of the invention to fill the blind hole completely with a cast (poured) material.

The blind hole and the insert may feature a cylindrical or frustoconical common wall, although other shapes (geometries) being possible.

The blind hole can feature a cross-section along a plane, which extends perpendicular to the axial extension (gas flow direction) of the gas purging element, from the group comprising: circular, rectangular, oval, star-like and polygonal. Other shapes (geometries) are possible.

The body is responsible for the gas transport within the gas purging element. Insofar it must feature a corresponding open porosity, for example a random porosity, or a so-called directed porosity. The random porosity is similar to a sponge, i. e. the gas flows from one pore into the next one and finally into a corresponding melt. The directed porosity is preferably achieved by corresponding channels, which extend between the first end and the second end of the body. Both types of porosity are as known from prior art.

While a random porosity (open porosity) of the body is typically set between 10 and 50% by volume (with upper optional limits at 40%, 30% or 25% and lower optional limits at 15 or 20%) the total open volume of any channels to achieve a directed porosity is considerably lower and typically less than 1% by volume, often less than 0.1% by volume with respect to the total body volume and thus negligible with respect to the total porosity of the body.

In other words: In case of a gas purging element with a cast gas permeable body, which per se features an open porosity of about 10 to 30% by volume, which further features a number of gas channels for the gas transport into the melt, the total open porosity substantially corresponds to that of the cast body, excluding the channel volume.

In case of a substantially dense ceramic body (characterized by e.g. less than 5% by volume of open porosity) featuring gas channels for the gas transport, the total open porosity again corresponds more or less to that of the dense part of the gas purging element.

To feed the gas into the open pores of the random porosity or into said channels, a gas distribution chamber at the first end of the gas purging element is a favourable option to allow a constant gas flow through the gas purging element. As known from prior art constructions, the gas distribution chamber is fluidly connected to corresponding gas supply means like a gas feeding pipe.

The inventive concept allows to use an MgO-based refractory ceramic material for said body, wherein the MgO-content may exceed 80% by weight, in an embodiment more than 90% by weight. According to a specific embodiment the body material features the following analysis in mass %: MgO: 96; $Al_2O_3$: 0.1; $Fe_2O_3$: 0.6; CaO: 1.9, $SiO_2$: 0.9, remainder: impurities, always established after annealing of the probe according to EN ISO 12677.

As an alternative a Magnesia-Chromite-material, comprising MgO and $Cr_2O_3$ in a total amount of e.g. more than 80% by weight can be used to provide the gas permeable body.

The apparent density (EN ISO 1927-5) of the body may be set at values of <2.9 g/cm$^3$, although values of <2.6 g/cm$^3$ are suitable for most applications.

The monolithic filler material (castable), from which the insert is made, can be a cement castable, for example a material comprising more than 80% by weight of $Al_2O_3$, in an embodiment more than 90% by weight. According to a specific embodiment the insert material features the following analysis in mass %: MgO: 0.2; $Al_2O_3$: 95; $Fe_2O_3$: 0.2; CaO: 4.4, $SiO_2$: 0.2; always established after annealing of the probe according to EN ISO 12677.

The apparent density (EN ISO 1927-5) of the insert may be set at values of >3 g/cm$^3$, although values of >2.6 g/cm$^3$ are suitable for most applications.

The difference in density between the body and the insert should be at least 8%, with alternative lower limits being 10%, 12% or 15%.

Typically the insert features the higher density. Assuming a body density of 2.6 g/cm$^3$, the density of the insert should be at least 2.81 g/cm$^3$. The larger the difference in density between body and insert is set, the more reliable is the wear indication when the gas purging element is worn down to the upper end of the insert. This refers to the possibility to visually distinguish the insert from the surrounding body material when the wear of the gas purging element has reached the insert.

As far as the cast insert is qualified as an item with a gas permeability different to that of the permeable body, the gas permeabilities of said body and insert should differ by at least 30% or at least 50%, wherein a substantially "gas tight" insert represents one possible embodiment. "Gas tight" includes an open porosity of up to 5% by volume.

The same is true when the difference in density is substantially caused by the open porosity of the insert and the body with typical values as disclosed above, wherein the open porosity of the item, featuring the higher open (random) porosity (typically the body) is at least 1.3 times the open porosity of the item, featuring the lower open (random) porosity (typically the insert), optionally at least 1.4 times, at least 1.5 times or at least 1.7 times. The total open porosity of the body may be set between 20 and 40% by volume or between 25 and 35% by volume, while the total open porosity of the insert is between 10 and 20% by volume or between 5 and 15% by volume.

While the gas permeability of the body, which is mainly responsible for the gas transport through the gas purging element, typically extends to 50 to 300 nPerm, the gas permeability of the insert will be set considerably lower and even down to values of less than 10 nPerm.

The gas purging element can be provided with further means, e.g. a peripheral metallic envelope, which also covers its first end, with an opening to allow the gas to flow in.

BRIEF DESCRIPTION OF THE DRAWINGS

The invention will now be described by a way of example with respect to the attached drawing, featuring

DETAILED DESCRIPTION OF EMBODIMENTS OF THE INVENTION

Figure 1:
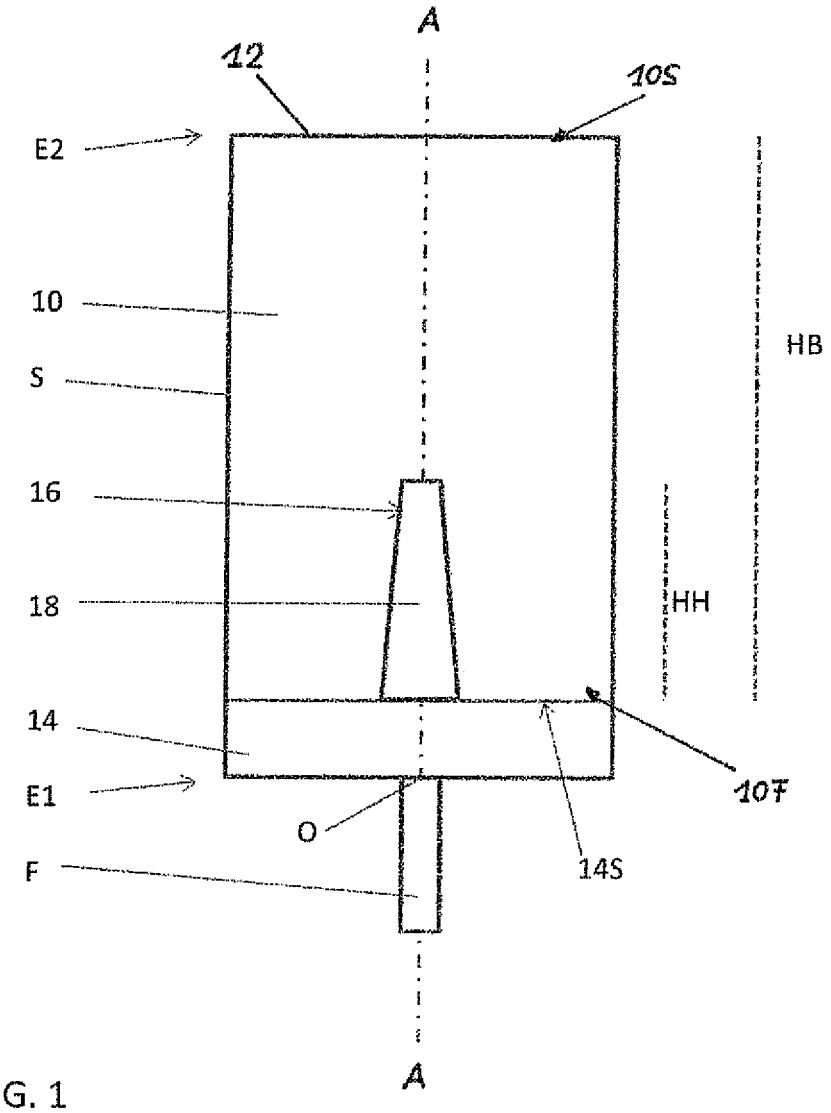
FIG. 1: A sectional view of a first embodiment of the refractory gas purging element.

According to FIG. 1 the refractory ceramic gas purging element features an axial extension (A-A) between a first end (lower end) E1 and a second (upper) end E2.

The gas purging element comprises a gas permeable body 10, which is made of a pressed MgO-based refractory ceramic material with an open random porosity of about 25% by volume, featuring a density of 2.8 g/cm$^3$. This allows a gas, supplied at the first end E1 via a gas feeding pipe F, to pass through the open pores of said body 10 and to leave the body 10 at the second end E2 via an uncovered upper surface 12 of said body 10.

The body 10 itself is peripherally covered by a steel envelope S, which also covers the lower first end E1 and comprises one opening O, from which the gas feeding pipe F extends outwardly, i.e. in the Figures, downwardly.

The body 10 extends from the second end E2 of the gas purging element towards the first end E1 but ends at a distance to said first end E1, thereby providing a gas distribution chamber 14. The overall height of body 10 is identified as HB, its first, lower end as 10F and its second, upper end as 10S.

The gas distribution chamber 14 is limited at its upper end by a steel plate 14*s*, which is welded to the outer steel envelope S and which abuts the first end 10F of said body 10.

Body 10 further features a blind hole 16 of frustoconical shape at its lower end 10F (adjacent to E1), which blind hole 16 extends from the first, lower end 10F of body 10 towards its second end 10S with an axial height HH being approximately 0.4 of the axial height HB of body 10.

The blind hole 16 is filled with a monolithic insert 18, which is substantially gas tight (3% by volume open porosity) and made of a refractory ceramic Alumina based castable, which was in-situ cast into said blind hole 16. Thereafter the insert unit was tempered at 200° C. for 3 hours, finally featuring a density of 3.1 g/cm$^3$, i.e. ca. 11% higher than that of the body.

The lower first end 10F of body 10 abuts against the steel plate 14*s* as does the lower end of insert 18. While the steel plate 14*s* is perforated in its ring shaped contact zone vis-a-vis body 10 (to allow the gas to enter the porous body 10), said steel plate 14*s* is not perforated in its contact zone vis-à-vis the gas-tight insert 18.

The gas, fed via the gas feeding pipe F into gas distribution chamber 14, thereafter penetrates the open porosity of body 10 before leaving said body 10 via its surface 12 into an adjacent metal melt.

Figure 2:
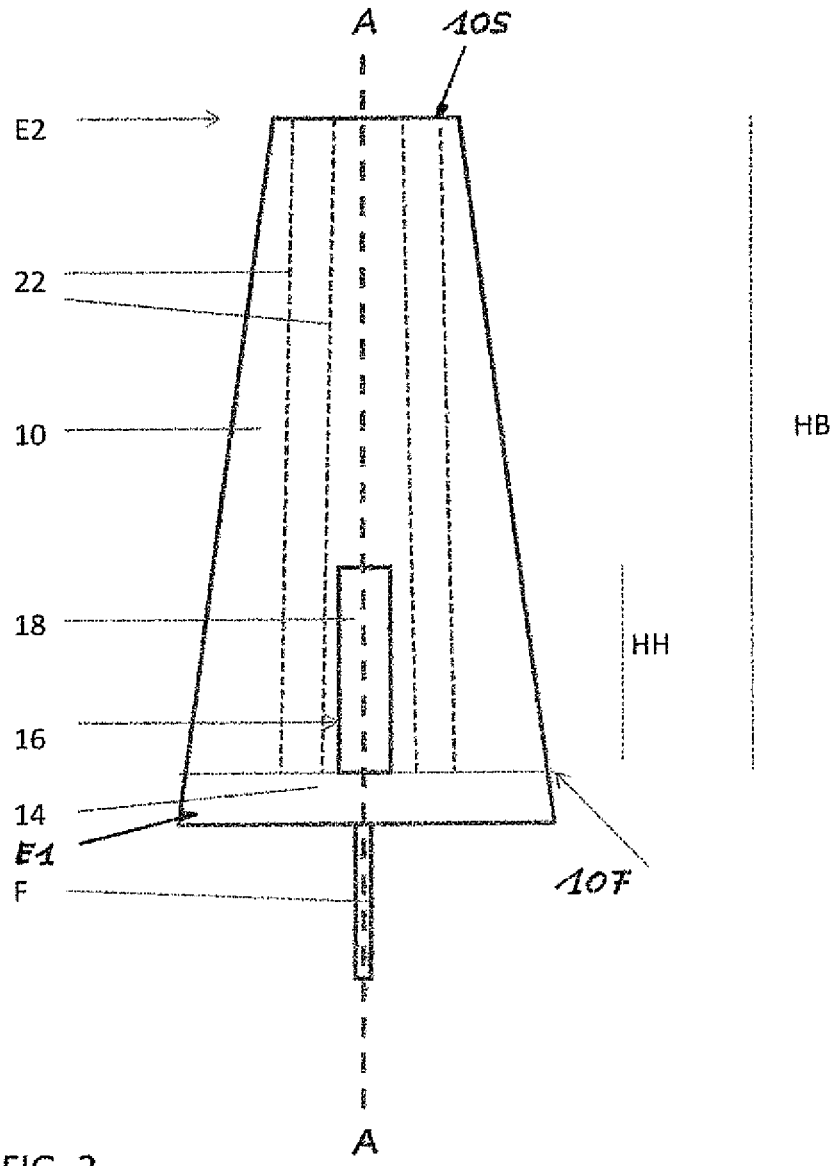
FIG. 2: A sectional view of a second embodiment of the refractory gas purging element.

The embodiment according to FIG. 2 is similar to that of FIG. 1. Insofar only characteristic differences are mentioned hereinafter:

While the overall shape of the gas purging element according to FIG. 1 is cylindrical and insert 18 features a frustoconical shape, FIG. 2 presents a frustoconical gas purging element comprising a cylindrical insert 18.

Insert 18 is made of a low cement castable (comprising 94% by weight $Al_2O_3$, requiring 5% by weight water), which was poured in-situ into a corresponding blind hole 16 at the first end 10F of body 10 and then tempered as in the previous example.

Insert 18 according to FIG. 2 has a density of about 3.1 g/cm$^3$ and an open porosity of about 14 by volume.

Body 10, which according to this embodiment is a cast item comprising gas channels 22 (so-called directed porosity), features a density of only 2.6 g/cm$^3$ and a total open porosity of 27% by volume.

The gas permeability of the body is ca. 150 nPerm and that of the insert about 2 nPerm.

The gas permeability is always identified according to ASTM C577-07$^{\varepsilon 2}$.

We claim:

1. A refractory ceramic gas purging element, featuring a) an axial extension between a first end, which provides means to supply a gas into the gas purging element, and a second end, at which the gas may leave the gas purging element and enter into an adjacent metal melt, b) a body, made of a pressed MgO based refractory ceramic material, comprising more than 80% by weight of MgO, and designed to allow the gas supplied at the first end of the gas purging element, to pass through the body and to leave the body at the second end of the gas purging element, wherein c) the body extends from the second end of the gas purging element towards the first end of the gas purging element, thereby defining an axial height HB of the body, with a first end, adjacent to the first end of the gas purging element, and a second end, corresponding to the second end of the gas purging element, d) a blind hole, which extends from the first end of the body towards its second end, thereby defining an axial height HH of the blind hole, with HB being larger than HH, wherein e) the blind hole is filled with an insert, made of a refractory ceramic material, comprising more than 80% by weight of $Al_2O_3$, which features a density different to that of the body and which is in-situ cast into said blind hole.

2. The gas purging element of claim 1, wherein the axial height HH of the blind hole corresponds to at most 50% of the axial height HB of the body.

3. The gas purging element of claim 1, wherein the blind hole and the insert feature a cylindrical or frustoconical common wall.

4. The gas purging element of claim 1, wherein the blind hole features a cross section along a plane, which extends perpendicular to the axial extension of the gas purging element, from the group comprising: circular, rectangular, oval, star-like and polygonal.

5. The gas purging element of claim 1, wherein the body features a random porosity of 10 to 50% by volume with respect to a total volume of the body.

6. The gas purging element of claim 1, wherein the body features a directed porosity, provided by channels, which extend between the first and second end of the body.

7. The gas purging element of claim 1, further comprising a gas distribution chamber, which is arranged adjacent to the first end of the body and fluidicly connectable to corresponding gas supply means.

8. The gas purging element of claim 1, wherein the body is made of a refractory ceramic material, comprising MgO and $Cr_2O_3$ in a total amount of more than 80% by weight.

9. The gas purging element of claim 1, wherein the insert is made of a cement castable.

10. The gas purging element of claim 1, wherein the insert was tempered after casting into the blind hole.

11. The gas purging element of claim 1, wherein the density of the insert differs from that of the body by at least 8%.

12. The gas purging element of claim 1, wherein the insert has an open porosity which differs from that of the body by at least 30%.

13. The gas purging element of claim 1, wherein the insert differs from the body by at least one of the following:

a higher density, a lower open porosity a smaller gas permeability.

* * * * *